United States Patent [19]

Kanarvogel

[11] Patent Number: 4,634,027

[45] Date of Patent: Jan. 6, 1987

[54] LIQUID DISPENSING APPARATUS AND AN ANTI-DRIP VALVE CARTRIDGE THEREFOR

[75] Inventor: Leon Kanarvogel, Hicksville, N.Y.

[73] Assignee: MVM Valve Co., Inc., Hicksville, N.Y.

[21] Appl. No.: 688,862

[22] Filed: Jan. 4, 1985

[51] Int. Cl.[4] ..... B67D 5/00

[52] U.S. Cl. ..... 222/380; 222/389; 222/496; 137/541; 251/333; 604/183; 604/236

[58] Field of Search ..... 222/389, 380, 494, 496, 222/497, 386, 571, 518, 387, 495, 309; 137/540, 541, 542; 604/183, 184, 181, 236; 285/331, 332; 251/336, 337, 318, 333, 900

[56] References Cited

U.S. PATENT DOCUMENTS

| | | | |
|---|---|---|---|
| T884,012 | 3/1971 | Blades et al. | 137/541 |
| 1,367,008 | 2/1921 | Bessesen | 604/184 |
| 1,401,765 | 12/1921 | Davis . | |
| 1,774,690 | 9/1930 | Willoughby | 137/541 |
| 1,912,022 | 5/1933 | Thompson . | |
| 2,264,632 | 12/1941 | Gerlitzki . | |
| 2,374,368 | 4/1945 | Mejia | 604/183 |
| 2,538,364 | 1/1951 | James et al. . | |
| 2,568,026 | 9/1951 | Pigott . | |
| 2,643,655 | 6/1953 | McKay | 604/184 |
| 2,645,242 | 7/1953 | Monnich . | |
| 2,808,293 | 10/1957 | Schenk . | |
| 2,845,066 | 7/1958 | Hoppe . | |
| 2,893,647 | 7/1959 | Wortman . | |
| 3,090,383 | 5/1963 | Brooks . | |
| 3,094,141 | 6/1963 | Mainenknecht . | |
| 3,122,160 | 2/1964 | Carr et al. . | |
| 3,189,046 | 6/1965 | Callahan et al. . | |
| 3,255,774 | 6/1966 | Gallagher et al. . | |
| 3,272,218 | 9/1966 | Johnson . | |
| 3,288,167 | 11/1966 | Gibson . | |
| 3,327,904 | 6/1967 | Goda et al. | 222/386 X |
| 3,409,039 | 11/1968 | Nelson . | |
| 3,478,934 | 11/1969 | Lindquist . | |
| 3,620,418 | 11/1971 | Stevens et al. . | |
| 3,756,273 | 9/1973 | Hengesbach . | |
| 3,856,043 | 12/1974 | Feild et al. . | |
| 3,921,858 | 11/1975 | Bemm | 222/389 |
| 4,051,852 | 10/1977 | Villari . | |
| 4,133,312 | 1/1979 | Burd | 285/332 X |
| 4,229,413 | 10/1980 | Marteau d'Autry . | |
| 4,387,854 | 6/1983 | Dupont | 137/541 |
| 4,410,108 | 10/1983 | Minard . | |

FOREIGN PATENT DOCUMENTS

| | | | |
|---|---|---|---|
| 14330 | of 1929 | Australia | 604/236 |

*Primary Examiner*—Joseph J. Rolla
*Assistant Examiner*—Kevin P. Shaver
*Attorney, Agent, or Firm*—David M. Rosenblum

[57] ABSTRACT

A liquid dispensing apparatus is provided having a container for storing the liquid to be dispensed, an anti-drip valve cartridge connected to the container and a needle element connected to the valve cartridge. A device is provided for pressurizing the container for the duration of a time interval and for depressurizing the container to atmospheric pressure, simultaneously, with the end of the time interval. The valve cartridge has an outlet portion which sealably connects an outlet opening thereof in registry with the bore of the needle element. A pressure activated poppet valve can be provided in the valve cartridge to seal the outlet opening upon the depressurization of the container. After depressurization, a volume of liquid is left in the needle element which exerts a pressure at the end of the needle element that is less than the incoming atmospheric pressure. As a result, liquid will not drip from the end of the needle element after the depressurization of the container and thus the dispensing of the liquid.

An air barrier can be provided in the container to prevent airation of the liquid to be dispensed. Additionally, a liquid induction fitting and a liquid storage tank can be provided for automatic refill of the container.

15 Claims, 10 Drawing Figures

FIG. 2
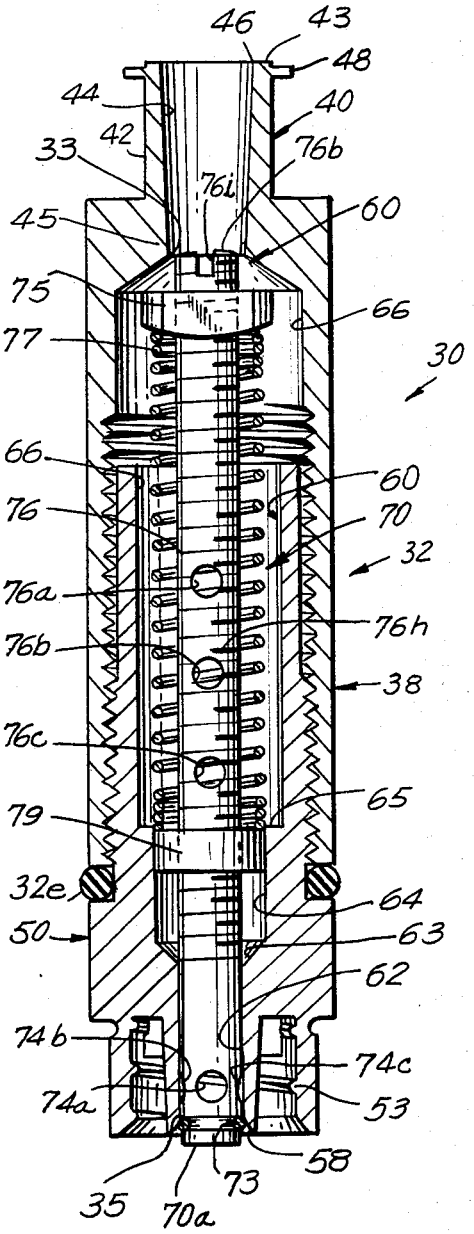
FIG. 3
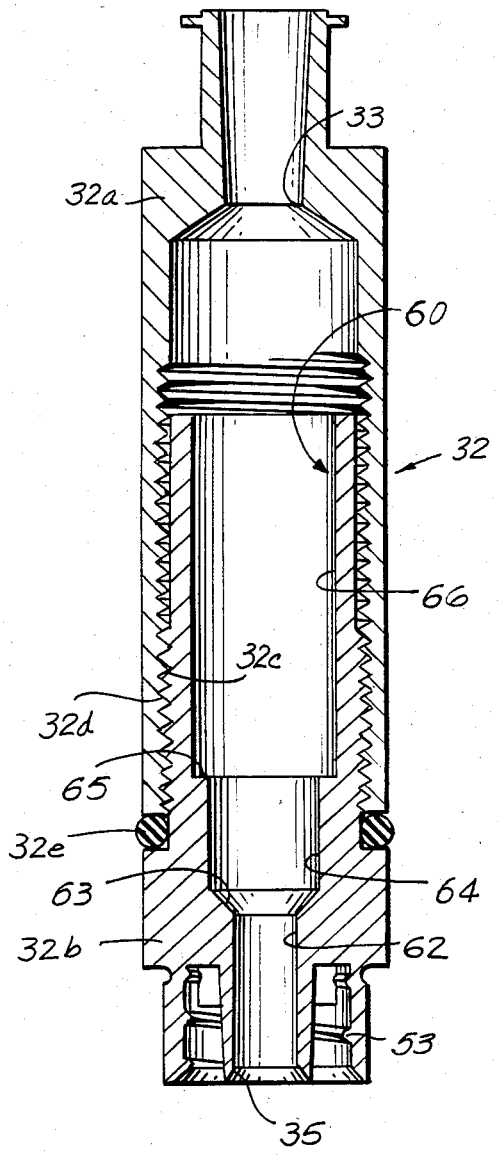
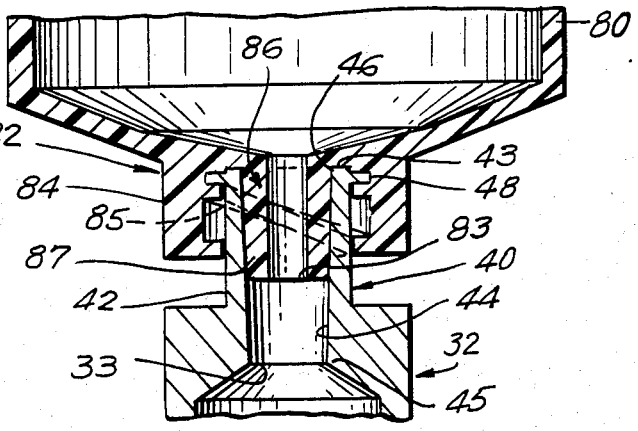
FIG. 4

LIQUID DISPENSING APPARATUS AND AN ANTI-DRIP VALVE CARTRIDGE THEREFOR

FIELD OF THE INVENTION

This invention relates to a liquid dispensing apparatus and more particularly to a liquid dispensing apparatus utilizing an a anti-drip valve cartridge. Still, even more particularly this invention relates to an anti-drip valve cartridge.

BACKGROUND OF THE INVENTION

The industrial manufacture of a variety of products involves the dispensing of liquids onto substrates or into containers. For example, completed printed circuit boards are manufactured by applying minute amounts of conductive epoxy at locations required for electrical connections between electronic components and the etching of the printed circuit board. Other well known liquid dispensing applications commonly include the filling of containers with measured amounts of liquid product.

In order to accomplish such liquid dispensing the conventional liquid dispensing apparatus heretofore provided generally includes a syringe barrel and a hypodermic needle. The syringe contains the liquid to be dispensed and the needle, attached to the syringe, is utilized for the point dispensing of the liquid. An air pressure source, supplying pressurized air, is connected to the syringe to force the liquid contained therein through the hypodermic needle and onto the substrate or into the container. In at least one liquid dispensing apparatus, suction is applied within the container by routing pressurized air through a venturi. The purpose of this is to prevent the drip of liquid from the needle between dispensing cycles. When dispensing is required, the pressurized air is re-routed directly to the container. The routing of pressurized air can be controlled by a solenoid air valve. Depending upon the accuracy of the metering required, the air valve is actuated either by a manually operated switch or by an automatic timer actuated by the manually operated switch. In many of the liquid dispensing apparatus, including that of concern here, the operator simply holds the syringe and directs the hypodermic needle to the desired location of application. Stationary fixtures as well as fixtures controlled by digital computers are also utilized in combination with such liquid dispensing apparatus to hold the syringe and to direct the hypodermic needle.

The problem with the conventional apparatus is that even where suction is provided to prevent drip, it is difficult to accurately meter the dispensing of minute quantities of liquids. There exist many reasons for this, but primarily since apparatus using suction require a finite time interval to switch from negative to positive pressure, the time interval for switching introduces an inherent limitation as to the smallest volume of liquid that can be accurately dispensed during a dispensing cycle.

One aspect of the present invention is therefore, to provide a liquid dispensing apparatus including an anti-drip valve cartridge, which can accurately dispense very minute quantities of liquids having a very low viscosity without drip from the needle between dispensing cycles. Moreover, as will be discussed in greater detail hereinbelow, since the present invention does not use continual suction to prevent drip, an apparatus constructed in accordance with the teachings thereof requires less energy than a dispensing apparatus of the prior art. Additionally, since the liquid dispensing apparatus of the present invention only operates on positive pressure, a plurality of syringe and needle combinations can be pressurized by a single air pressure sourse. The advantage of this is that a liquid dispensing apparatus as taught by the present invention can be advantageously incorporated into an assembly line manufacturing scheme with a low cost of installation and a further reduction of operating costs over the prior art.

A central feature of the subject invention that provides its advantageous operation is the anti-drip valve cartridge thereof. As will be described in greater detail hereinafter, the valve cartridge of the subject invention incorporates a casing having an outlet opening and means for sealably connecting the casing to one end of a needle element with the outlet opening in registry with the bore of the needle element. When the outlet opening is sealed, the needle element contains a volume of liquid remaining therein which exerts a pressure that is less than the incoming atmospheric pressure acting against the liquid at the other end of the needle element. In a preferred embodiment, a pressure activated poppet valve can be used for sealing and unsealing the outlet opening. When the container is pressurized, the valve opens and liquid flows from the end of the needle element. When the container is depressurized, the valve closes to seal the outlet opening. As a result, after the time interval for pressurization or the dispensing cycle, a minimum volume of liquid remains in the needle element which is operable to be acted upon by the incoming atmospheric pressure so that when the product of the specific gravity and the height of the column of liquid in the needle element is less than atmospheric pressure liquid will not drip from the needle element after the dispensing cycle. Moreover, in such a preferred embodiment, the connection means can include elements of standard luerlock fittings so that the valve cartridge of the present invention can be used with some of the conventional elements of liquid dispensing apparatus of the prior art.

While the prior art is repleat with pressure activated poppet valves, the prior art does not disclose a valve incorporating the features briefly described above. In this regard the prior art provides check valves, all having valve seats centrally located within their casings. Such check valves therefore do not teach, among other aspects of the subject invention, a casing having connection means that connect the casing to the needle element with the outlet opening thereof in registry with the bore of the needle element. An example of a check valve of the prior art is U.S. Pat. No. 2,538,364, entitled, "Valve," which issued to R. W. James ET AL on Jan. 16, 1951. James ET AL discloses a valve catridge having a centrally located valve seat and a valve within the casing thereof. Another example is U.S. Pat. No. 3,255,774, entitled, "Adjustable Inline Relief Valve," which issued to E. J. Gallagher ET AL on June 14, 1966. Gallagher ET AL provides a valve cartridge having a pressure activated valve on the end of a hollow valve stem within a valve casing. The disclosed valve is biased against a valve seat in the inlet opening of the valve casing. U.S. Pat. No. 3,756,273, entitled, "Valve," which issued to Hengesbach on Sept. 4, 1973 again discloses a valve cartridge having a valve and a valve seat, both of which are centrally located within a casing. A review of these references also discloses that none of them provide for the sealable connection between an outlet opening of a casing and a needle element. In this regard, U.S. Pat. No. 4,051,852, entitled, "Aspirating Device," which issued to Villari on Oct. 4, 1977 discloses a valve cartridge which can be positioned between a syringe and a needle element by provision of a set of standard medical male and female luerlock fittings. However, the disclosed valve is a spring loaded, ball check valve to prevent back flow from the outlet opening. The valve itself is, again, centrally located within the casing. It therefore, also does not disclose a connection means that could produce the anti-drip feature of the valve catridge of the subject invention. U.S. Pat. No. 2,845,066, entitled, "Syringe With Attached Serum Bottle," which issued to C. T. Hoppe on July 29, 1958 discloses a ball check valve sealing an opening in the end of a syringe. Obviously, Hoppe does not disclose a valve cartridge. Additionally, it does not teach the connection means of the subject invention and the anti-drip capability that is inherently provided thereby. Hence, besides the fact that such an assembly could not be used with conventional components of the liquid dispensing apparatus of the prior art, the needle element thereof would drip upon the relaxation of pressure within the syringe.

SUMMARY OF THE INVENTION

The present invention provides a liquid dispensing apparatus. The liquid dispensing apparatus includes a container, a needle element that comprises a standard industrial blunt, means for pressurizing and depressurizing the container, and an anti-drip valve cartridge. The container contains the liquid to be dispensed and has an aperture in the bottom thereof. The needle element comprises a hollow needle and a female coupling. The hollow needle has a connected end, an unconnected end opposite to the connected end and an axial bore therethrough communicating between the connected end and the unconnected end. The female coupling is connected to the hollow needle and has a pair of opposed ends, a tapered bore communicating between the ends of the female coupling, a mouth and a radially extending flange. The narrowmost section of the tapered bore is in registry with the axial bore of the hollow needle at one of the ends of the female coupling and at the connected end of the hollow needle. The widestmost section of the tapered bore is located at the other of the ends of the female coupling. The mouth is defined by the widestmost section of the tapered bore. The radially extending flange is connected to the outside of the female coupling seal with the mouth thereof. The means for pressurizing and depressurizing the container more specifically are means for pressurizing the container for the duration of a time interval, to thereby force liquid from the aperture of the container, and for depressurizing the container to atmospheric pressure, simultaneously, with the end of the time interval.

The anti-drip valve cartridge comprises a casing and means for sealing and unsealing an outlet opening of the casing. The casing is operable to be located between the container and the needle element. The casing includes a central portion, an inlet portion, an outlet portion and a passageway communicating between an inlet opening in the inlet portion and an outlet opening which is located in the outlet portion. The inlet portion is connected to the central portion has has an inlet opening and sealable connection means for sealably connecting the casing to the container with the inlet opening in communication with the aperture of the container. The outlet portion, which is spaced apart from the inlet portion, is also connected to the central portion. The outlet portion has an outlet opening and means for sealably connecting the casing to the needle element with the outlet opening in registry with the tapered bore of the needle element. The sealable connection means for connecting the casing to the needle element include a depending nozzle member configured to project into the mouth of the needle element and seal within the tapered bore thereof and a cylindrical flange of a male luerlock fitting. The nozzle member has a proximal end and a distal end operable to extend within the tapered bore of the needle element. The nozzle member is connected to the central portion by its proximal end. The nozzle member has the outlet opening located on its distal end. The cylindrical flange is connected to the central portion in a coaxial relationship with the nozzle member. The nozzle member is situated within the cylindrical flange and the central axis of the cylindrical flange is coincident with the central axis of the nozzle member. The cylindrical flange has a plurality of threads therein configured to threadably engage the radially extending flange of the needle element.

The sealing and unsealing means are means, associated with the outlet opening, for unsealing the outlet opening for the duration of the time interval, so that the liquid under the application of pressure is forced from the aperture of the container, into the inlet opening, through the passageway, out of the outlet opening, through the needle element and out of the unconnected end thereof. The means are also for sealing the outlet opening simultaneously with the end of the time interval. As a result, after the time interval, a volume of liquid remains in the needle element which is operable to be acted upon by the incoming atmospheric pressure at the unconnected end of the hollow needle so that when the product of the specific gravity of the liquid remaining in the needle element and the difference between the length of the needle element and the length of the nozzle member sealed within the tapered bore of the needle element is less than that of the atmospheric pressure, liquid will not drip from the needle element.

More specifically, the sealing and unsealing means include an outwardly opening pressure activated poppet valve sized for reciprocating movement beyond the outlet opening of said nozzle member and within the tapered bore of the needle element between a closed and seated position with sealing the outlet opening and an open unseated position of maximum valve stroke, towards but spaced from the narrowmost section of the tapered bore of the needle element, when unsealing the outlet opening. The poppet valve has means for biasing the poppet valve in its closed and seated position. To this end the depending nozzle member comprises a truncated tip member of a male luerlock fitting configured to seal within the tapered bore of the needle element when extended through the mouth thereof. The nozzle member further has, a valve seat configured to seal against the poppet valve when in its closed and seated position. The valve seat is located on the distal end of the nozzle member and has an annular configuration, the inner periphery of which defines the outlet opening and the outer periphery of which is located on the distal end of the nozzle member.

BRIEF DESCRIPTION OF THE DRAWINGS

While the specification concludes with claims particularly pointing out and distinctly claiming the subject matter which is regarded as the present invention, it is believed that the invention will be better understood from the following description taken in connection with the accompanying drawings in which:

FIG. 2 is a crossectional view of the anti-drip valve cartridge of the present invention as viewed along line 2—2 of FIG. 1.

FIG. 3 is a crossectional view of the anti-drip valve cartridge of the present invention as illustrated in FIG. 2 with the preferred valve thereof removed to thereby illustrate the details of the casing.

FIG. 4 is an enlarged, fragmentary crossectional view of the anti-drip valve cartridge and container as viewed along line 4—4 of FIG. 1.

DESCRIPTION OF THE PREFERRED EMBODIMENT

Figure 1:
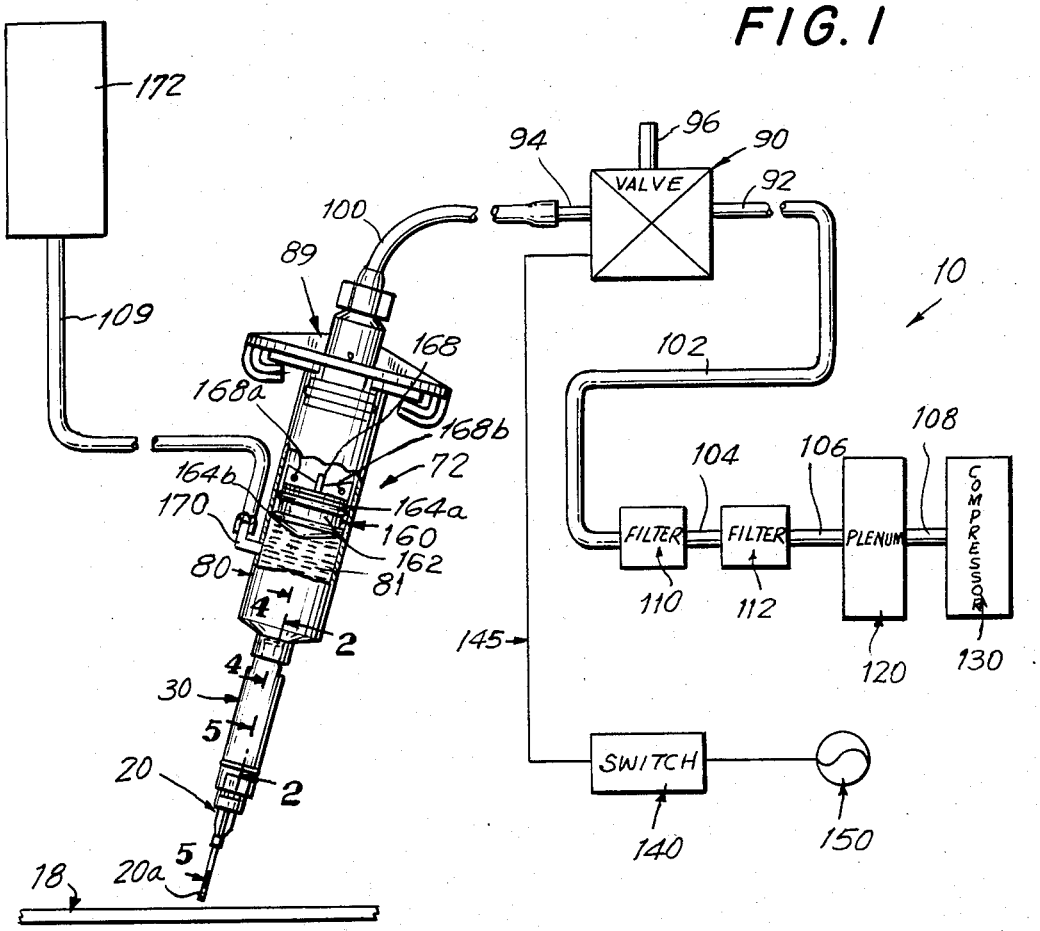
FIG. 1 is an elevational view of the liquid dispensing apparatus of the present invention with elements thereof schematically illustrated. A portion of the sidewall of the container is removed to expose a preferred air barrier to be used therein.

Referring now to FIG. 1, the liquid dispensing apparatus 10 of the present invention can generally comprise a needle element 20, a container 80 and an anti-drip valve cartridge 30 sealably connecting container 80 to needle element 20. Container 80, which can be a syringe barrel containing a liquid 81, can be connected to a valve 90 by provision of an air induction fitting 89. Valve 90 can in turn be connected to a pair of air filters 110 and 112. Filters 110 and 112 can be serially connected to each other, to a plenum 120 and to an air compressor 130. Valve 90 can be a solenoid valve, electrically actuated by a switch 140, attached to a potential source 150.

Upon the closing of switch 140, valve 90 opens and compressed air supplied by air compressor 130 flows into container 80 to pressurize liquid 81. The pressure forces liquid 81 from container 80 into valve cartridge 30. As will be discussed in greater detail hereinafter, a pressure activated poppet valve 70 can be provided in valve catridge 30, which upon the application of pressure, simultaneously opens to permit liquid to flow through needle element 20 and to be applied onto substrate 18. After the dispensing cycle, that is the time interval for the pressurization of container 80, switch 140 is opened causing the cessasion of the electrical impulse and the closing of valve 90. When valve 90 is in its closed position, pressurized air in container 80 immediately vents to the atmosphere through another outlet of valve 90 to thereby depressurize container 80 to atmospheric pressure. This venting action simultaneously closes the preferred poppet valve 70 of valve catridge 30 to terminate the dispensing of liquid 81 from container 80.

Figure 9:
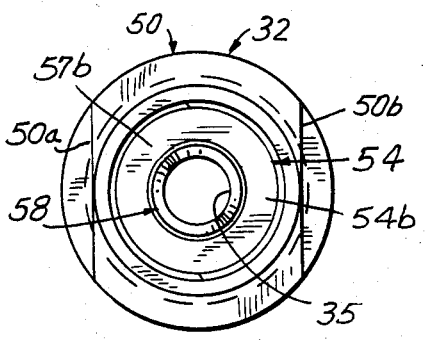
FIG. 9 is a bottom plan view of the anti-drip valve cartridge of the present invention with the valve illustrated in FIG. 7 removed to illustrate the valve seat thereof.
Figure 10:
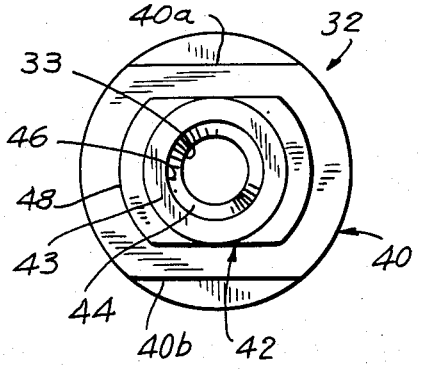
FIG. 10 is a top plan view of the anti-drip valve cartridge of the present invention.

Having thus generally described the subject invention a more detailed description follows with a discussion of the anti-drip valve cartridge 30. Turning now to FIGS. 2, 9 and 10 valve cartrage 30 can generally comprise a casing 32 and a pressure activated poppet valve 70. Casing 32 can be provided with an inlet portion 40 having an inlet opening 33 therein, an outlet portion 50 having an outlet opening 35 therein, a central portion 38 connecting the outlet portion 50 to the inlet portion 40 and a passageway 60 communicating between inlet opening 40 and outlet opening 50. In order that valve cartridge 30 be compact and lightweight, it is preferred that inlet opening 33 be located directly opposite to outlet opening 35. Moreover, inlet portion 40 and outlet portion 50 can include some of the conventional elements of standard, twist-on female and male luerlock fittings. The advantages of the use of such conventional elements allow the preferred valve cartridge 30 to be used with some of the conventional elements of the prior art liquid dispensing apparatus. As will be described in more detail hereinafter, poppet valve 70 forms part of the means required for the unsealing of the outlet opening 35 for the duration of the time interval for the pressurization of the container 80 and for the sealing of the outlet opening 35 simultaneously with the end of the time interval.

The inlet portion 40, as can best be seen in FIGS. 2, 4 and 10 has two major functional components: an inlet opening 33 and means for sealably connecting the casing 32 to the container 80 with the inlet opening 33 in communication with the aperture 83 of the container. As stated previously, inlet portion 40 can utilize elements of a female luerlock fitting and can include a female coupling 42 having an axial tapered bore 44 communicating between the opposed ends 43 and 45 thereof. The widestmost section of tapered bore 44 can define a mouth 46 in end 43 thereof. Additionally, a radially extending flange 48 can be connected to the outside of female coupling 42, level with mouth 46 thereof. Container 80 can be provided with a male luerlock fitting 82 to sealably connect to inlet portion 40. Male luerlock fitting 82 can include a cylindrical flange 84 having a plurality of threads 85 therein adapted for threaded engagement with radially extending flange 48. Additionally, luerlock fitting 82 can also include a coaxial, depending tip member 86 having a distal end 87 extending through flange 84. Tip member 86 is configured to project into mouth 46 of female coupling 42 by distal end 87 and seal within tapered bore 44 when radially extending flange 48 is threaded into threaded flange 84. As illustrated, inlet opening 33 can be defined by the narrowmost section of the tapered bore 44. Aperture 83 can be located in the distal end 87 of the tip member 86. As a result, when the male luerlock fitting 82 is connected to the inlet portion 40, inlet opening 33 is in communication with aperture 83.

Figure 5:
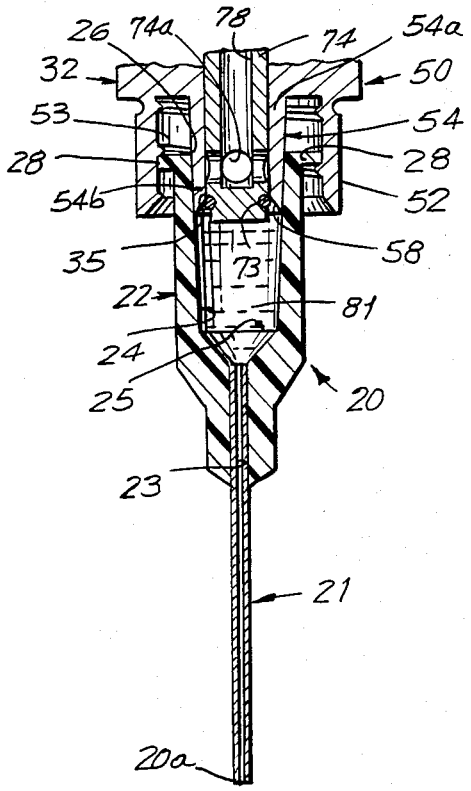
FIG. 5 is an enlarged, fragmentary crossectional view of the anti-drip valve cartridge and the needle element as viewed along line 5—5 of FIG. 1 either before or after the time interval for pressurization.
Figure 6:
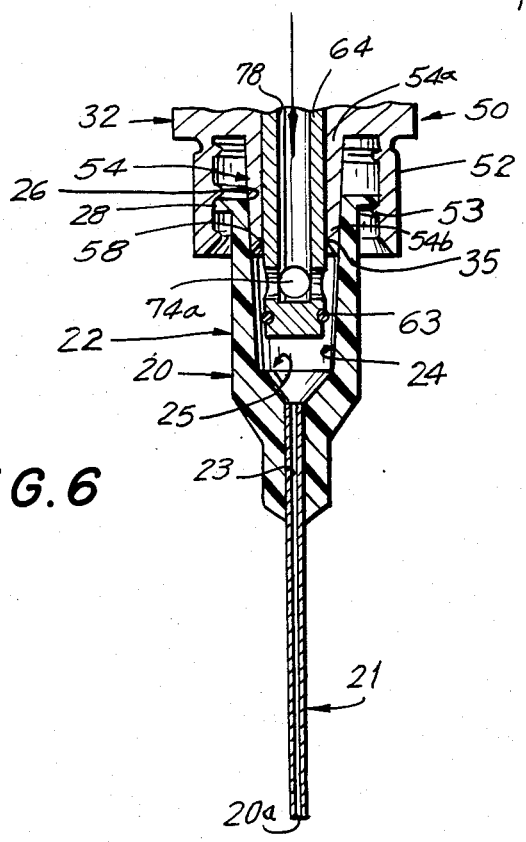
FIG. 6 is an enlarged, fragmentary crossectional view of the anti-drip valve cartridge and needle element as illustrated in FIG. 5 during the time interval for pressurization.

Outlet portion 50, as can best be seen in FIGS. 2, 5, 6 nd 9 has two major functional components: the outlet opening 35 and means for sealably connecting the casing 32 to one end of the needle element 20 with the outlet opening 35 in registry with the bore of the needle element 20. As stated previously, when the outlet opening 35 is sealed, a volume of liquid 81 remains in needle element 20 which is operable to be acted upon by the incoming atmospheric pressure acting against liquid 81 at the unconnected end 20*a* of the needle element 20 so that when the product of the specific gravity of the liquid remaining in the needle element 20 and the difference between the length of the needle element and the length of the nozzle member sealed within the tapered bore of the needle element is less than that of atmospheric pressure, liquid will not drip therefrom. Needle element 20 can be a standard industrial blunt that includes a hollow needle 21 having an axial bore 23, an unconnected end 20*a*, a connected end (within female coupling 22) and a female coupling 22 of a conventional female luerlock fitting. Female coupling 22 can have an axial tapered bore 24 communicating between the ends thereof, with the widestmost section of tapered bore 24 defining a mouth thereof at one of the ends. Thus, in the preferred embodiment, the bore of needle element 20 comprises bore 23 and axial tapered bore 24. Therefore, in the preferred embodiment the aforementioned means of outlet portion 50 sealably connect the casing 32 to the needle element 20 with outlet opening 35 in registry with tapered bore 24. Female couping 22 can be connected to hollow needle 21 with the narrowmost section 25 of tapered bore 24 being in registry with the axial bore 23. Additionally, as with all female twist-on luerlock fittings, there can also be provided a radially extending flange 28 level with the mouth 26 thereof. The means of outlet portion 50 for sealably connecting the casing 32 to the preferred needle element 20 with the outlet opening 35 in registry with the bore of the needle element 20 can generally be described with reference to a depending nozzle member 54 configured to project into mouth 25 of female coupling 22 of needle element 20 and seal within bore 24 thereof and a cylindrical flange 52 configured to threadably engage radially extending flange 28 of needle element 20. The illustrated, preferred nozzle member 54 includes a proximal end 54*a* and a distal end 54*b* operable to be extended within tapered bore 24. Nozzle member 54 is connected to central portion 38 by proximal end 54*a*. Nozzle member 54 preferably comprises a truncated tip member of a a male luerlock fitting with proximal end 54*a* having the diameter of the widestmost section of a tip member of a male luerlock fitting. As illustrated in FIG. 4, this diameter would be the diameter of for instance, mouth 46. Outlet opening 35 can be located on the distal end 54*b* of the nozzle member 54. As has been previously mentioned, the preferred sealing means for outlet opening 35 can include a pressure activated, outwardly opening poppet valve 70 operable for reciprocating movement between a seated position when sealing outlet opening 35 and an unseated position of maximum valve stroke when unsealing outlet opening 35. An annular valve seat 58 can be provided on the distal end 54*b* of nozzle member 54. Valve seat 58, the inner periphery of which defines outlet opening 35, is configured to seal against valve 70, or vice versa, when in the seated positon. In order to couple nozzle member 54 to preferred needle element 20, and utilize preferred valve 70, nozzle member 54 preferably has a length, as measured between proximal end 54*a* to distal end 54*b*, equal to the difference between the length of a tip member of a male luerlock fitting and the maximum possible displacement of valve 70 from distal end 54*b* and outlet opening 35 at its position of maximum valve stroke, as measured from the end of valve 70 closest to the narrowmost section 25 of tapered bore 24 to the distal end 54*b*. In addition to its sealing function, and its function of providing the necessary registry between the outlet opening 35 and the bore of needle element 20, nozzle member 54 also displaces a volume of liquid 81 when sealed in tapered bore 24. Thus, an inherent advantage in including nozzle member 54 in the preferred embodiment is that the volume and height of liquid 81 remaining in the neddle element 20 after the sealing of the outlet opening 35 is thereby minimized. Cylindrical flange 52 physically connects the preferred needle element 20 to the casing 32. Cylindrical flange 52 can therefore be a cylindrical flange of a male luerlock fitting having a plurality of threads 53 therein configured to threadably engage the radially extending flange 28 of needle element 20. As illustrated, cylindrical flange 52 is connected to the central portion 38 of the casing 32 in a coaxial relationship with the nozzle member 54, with the nozzle member situated within the cylindrical flange 52 and with the central axis of cylindrical flange 52 and nozzle member 54 being coincident.

Referring now to FIGS. 2 and 3, passageway 60 can preferably comprise a primary bore 62, a secondary bore 64 and tertiary bore 66. The primary bore 62 can be of cylindrical configuration. As illustrated, primary bore 62 extends inwardly from outlet opening 35, towards inlet opening 33. Secondary bore 64 can also be of cylindrical configuration. As illustrated, secondary bore 64 extends inwardly from primary bore 62, towards the inlet opening 33. Tertiary bore 66 can likewise be of cylindrical configuration and as illustrated, extends inwardly from secondary bore 64, towards the inlet opening 33. The diameter of the secondary bore 64 is greater than that of the primary bore 62 to thereby define a primary shoulder 63. The diameter of the tertiary bore 66 is in turn greater than that of the secondary bore 64 to thereby define a secondary shoulder 65. As will be discussed, the construction of the central passageway 60 functions and coacts with the poppet valve 70. Thus, in an appropriate valve construction, passageway 60 and bores 62, 64 and 66 could be modified in accordance with the valve design. However, as will become apparent, the illustrated, preferred embodiment of passageway 60 has distinct advantages in its operation. It is of course required that valve cartrage 30 be provided with a passageway, communicating between the inlet opening 33 and the outlet opening 35 to permit operation of the valve cartridge 30. Other features and requirements of the preferred passageway 60 will be discussed hereinafter in conjunction with the preferred poppet valve 70.

Casing 32 can be of cylindrical configuration and can comprise a pair of separable sections, 32*a* and 32*b* which can be separated from one another at a circumferential juncture between sections 32*a* and 32*b* defined by an imaginary plane passing at right angles through central portion 38. A threaded connection can be provided between sections 32*a* and 32*b* by internal threads 32*c* and external threads 32*d*. A gasket 32*e* can be provided to seal casing 32. Gasket 32*e* is located at the aforementioned circumferential juncture between sections 32*a* and 32*b* when the sections are threadably connected to one another. Gasket 32*e* thus defines the previously discussed plane passing at right angles through central portion 38. As illustrated in FIGS. 9 and 10, the separation and connection of the sections 32*a* and 32*b* can be facilitated by provision of a pair of wrench flats 40*a* and 40*b* of inlet portion 40 and a pair of wrench flats 50*a* and 50*b* of the outlet portion 50. The sections 32*a* and 32*b* permit the access to the associated subassemblies of the casing 32 and the poppet valve 70. It is understood however, that the casing 32 could incorporate one piece construction and that the separable sections 32*a* and 32*b* could therefore be omitted. Moreover, although casing 32 is of cylindrical configuration with a single outlet portion 50, it is further understood that the casing 32 could have a plurality of such outlet portions, such as 50 to sealably connect to a plurality of needle elements, such as 20.

Figure 7:
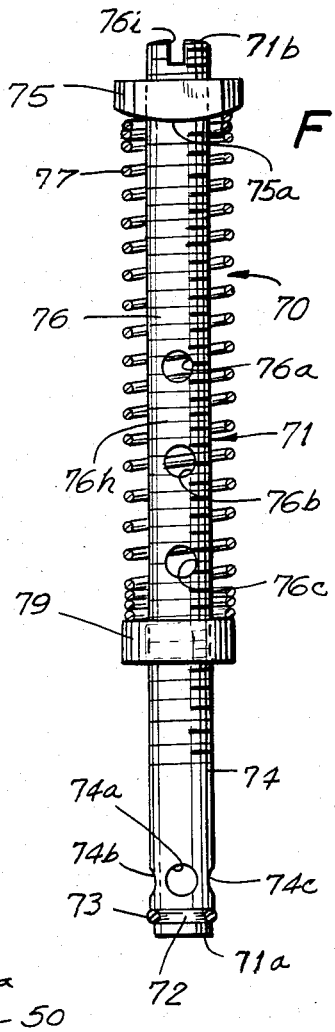
FIG. 7 is an elevational view of the preferred poppet valve of the present invention.
Figure 8:
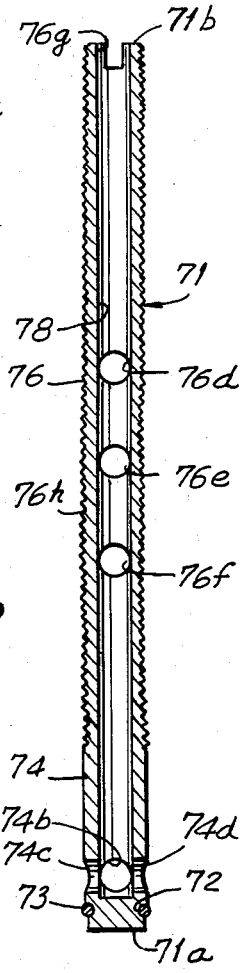
FIG. 8 is a crossectional view of the stem and shank sections of the valve illustrated in FIG. 7.

As has been previously mentioned, valve cartridge 30 is provided with means for sealing and unsealing outlet opening 35. These means can include an outward opening, pressure activated poppet valve 70 configured to seat in valve seat 58. Referring now to FIGS. 2, 7 and 8, it can be seen that poppet valve 70 can include an elongate member 71 comprising a shank section 74 and an adjacent stem section 76. The shank section 74, can be of cylindrical configuration and can be sized to produce a close fitting sliding engagement within the outlet opening 35 to prevent leakage of liquid 81 between the circumference of the shank section 74 and outlet opening 35. Since the primary bore 62 can preferably have a diameter equal to that of the outlet opening 35 and a length equal to that of the shank section 74, shank section 74 can also be said to be sized to produce a close fitting sliding engagement within primary bore 62. The shank section 74 is provided with a circumferntial groove 72 at the end thereof formed by the end 71*a* of member 71. An 'O' ring 73 can be located within the circumferntial groove 72. 'O' ring 73 is configured to seal against valve seat 58 when valve 70 is in its closed and seated position, sealing outlet opening 35. This seated position of valve 70 is illustrated by FIG. 5. The valve 70 is pressure activated, that is upon the application of a liquid pressure, valve 70 unseats from valve seat 58 to an unseated position of maximum valve stroke when unsealing outlet opening 35. This opened position of valve 70 is illustrated by FIG. 6. Valve seat 58 preferably has an inwardly sloping, frustroconnical configuration. The outer periphery of the valve seat 58 can be located on the distal end 54*b* of the nozzle member 54. The inner periphery of valve seat 58 thereby defines the outlet opening 35.

Stem section 76, which is adjacent to the shank section 74, extends into passageway 60 when valve 70 is installed in the casing 32. Since the shank section 74 and therefore the elongate member 71 is sized to produce a close fitting sliding engagement with the outlet opening 35 and the primary bore 62, the elongate member 71 is provided with a flow through channel 78 for transport of liquid 81 past the primary bore 62 and the outlet opening 35. As illustrated, flow through channel 78 axially extends through the stem section 76 and the shank section 74 to a location of the shank section 74 that is situated anterior to the circumferential groove 72. As can best be seen in FIGS. 7 and 8, the stem section 76 can include a set of three pairs of intake ports, 76*a*, 76*b*, 76*c*, 76*d*, 76*e* and 76*f* all in communication with the flow through channel 78. The pairs of intake ports 76*a* through 76*f* are spaced from shank section 74. As between pairs of intake ports, each pair can be equally spaced from another pair and each intake port of a pair can be located opposite to the other intake port of a pair. Additionally, since the flow through channel 78 extends through the stem section 74, a seventh intake port 76*g* is defined in the end of stem section 76 formed by end 71*b* of member 71. The shank section 74 can be provided with a set of four exhaust ports 74*a*, 74*b*, 74*c* and 74*d*, also all in communication with the flow through channel 78. The exhaust ports 74*a* through 74*d* are all located at the aforementioned location directly anterior to the 'O' ring 73, with each exhaust port located opposite to another of the exhaust ports and with each of the exhaust ports at right angles to an adjacent exhaust port.

As illustrated in FIGS. 5 and 6, the exhaust ports 74*a* through 74*d* and the frustroconnical valve seat 58 arrangement directs liquid 81, flowing from the exhaust ports (74*a* through 74*d*) against the junction of the valve seat 58 and the 'O' ring 73. This is preferred because the 'O' ring 73 can tend to pressure set on the valve seat 58 and the directed liquid 81 from the exhaust ports 74*a* through 74*d* tends to free the 'O' ring 73 under such circumstances. The same would hold true for applications in which adhesives are dispensed. Certain adhesives can tend to bond the 'O' ring 73 to the valve seat 58. Again, the preferred exhaust port (74*a* through 74*d*) and valve seat 58 arrangement tends to free poppet valve 70 for reciprocating movement. Another advantage of the 'O' ring 73 and valve seat 58 arrangement relates to chrome plating. As will be discussed in greater detail hereinafter, chrome plating is preferred for the illustrated, preferred embodiment. The chrome plating however, presents a problem in that it is difficult to accurately machine chrome plated articles; and thus it would be difficult if not impossible to seal a chrome plated valve seat with a chrome plated valve. For this reason a rubber to metal seal is provided for in the preferred embodiment by the combination of the 'O' ring 73 and the valve seat 58.

As can be appreciated, there could be more or less intake ports (76*a* through 76*g*) depending upon the viscosity of liquid to be dispensed. In this regard, there should of course be at least one intake port and at least one exhaust port in a valve having a similar operation to the preferred valve 70. The set of three pairs of intake ports 76*a* through 76*f*, spaced from shank section 74, are also preferred to insure that flow through channel 78 is always filled with liquid 81. This is important to prevent voids from occuring in the flow through channel 78 during a dispensing cycle.

Referring now to FIGS. 7 and 8, the stem section 76 can function with a spring 77 as means for biasing the valve 70 in its seated and closed position. Spring 77 can be a helically wound wire spring, fabricated from Phosphor Bronze. Phospher Bronze is a preferred material for spring 77 primarily because of its resistance to corrosion. Spring 77, as can best be seen in FIG. 7 is coaxially positioned with respect to stem section 76, with stem section 76 projecting through the coils of spring 77. In order for the spring 77 to properly function, it is of course necessary that the coils of the spring 77 have an outer diameter greater than that of the secondary bore 64 and less than that of the tertiary bore 66. As illustrated, stem section 76 can have a plurality of threads 76*h*. Additionally, a compression adjustment nut 75 can be provided and threaded onto stem 76. The adjustment nut 75 can be provided with a convex surface 75*a* to insure that spring 77 is centered with respect to stem section 76. Spring 77 bears against nut 75 and against secondary shoulder 65 to thereby bias valve 70 in its closed and seated position.

Valve 70 can also have means for adjusting the permissible, maximum valve stroke. These means can include a clutch nut 79 threaded onto stem section 76 a distance from the shank section 74 equal to the desired maximum valve stroke of valve 70. As can best be seen in FIG. 2, clutch nut 79 adjusts the maximum valve stroke of the valve 70 by abutting against the primary shoulder 63 when the valve 70 is in its closed and seated position.

In order to adjust the maximum valve stroke, stem section 76 is depressed towards outlet opening 35 to bring clutch nut 79 into contact with primary shoulder 63. At the same time, stem 76 is rotated to increase or decrease the maximum desired valve stroke of valve 70. In order to facilitate adjustment of the maximum valve stroke, a slot **76*i* can be provided in the end 71*b* of the elongate member 71 forming stem section 76. Slot 76*i* enables a screw driver to be inserted into inlet opening 33 for adjustment of maximum valve stroke when casing 32** is assembled.

As can be appreciated, an adjustment of maximum valve stroke also adjusts the maximum opening of the exhaust ports **74*a* through 74*d* past outlet opening 35; and thus under a given time and pressure the amount of liquid 91 that can be dispensed during a dispensing cycle. It is appropriate to point out that valve 70 and casing 32 is preferably configured such that end 71*a* does not obstruct axial bore 23 of needle element 20 when valve 70 is in its position of maximum valve stroke. However, an embodiment of the present invention could be constructed in which end 71*a* would obstruct bore 23 of needle element 20** at the position of maximum valve stroke. In such an embodiment the valve stroke adjustment as described above would be utilized to prevent such obstruction. The valve stroke adjustment means could of course be deleted from a possible embodiment of the present invention with the concommitant loss of the advantageous valve operation as described above.

As illustrated, the primary shoulder 63 is tapered towards the outlet opening 35. As viewed with respect to the central axis of passageway 60, primary shoulder 63 preferably incorporates a taper of less than or equal to 79 degrees. Primary shoulder 63 could of course be oriented at right angles to the central axis of passageway 60. However the advantageous adjustment operation, as described above, could not be accomplished without some degree of slippage between clutch nut 79 and primary shoulder 63.

The amount of liquid 81 that is dispensed during each dispensing cycle can be adjusted. The operation of clutch nut 79 to effectuate such adjustment has been previously described. Decreasing maximum valve stroke decreases the amount of liquid 81 that is dispensed during each dispensing cycle. Increasing maximum valve stroke increases the amount of liquid 81 that is dispensed during each dispensing cycle. As can be appreciated, the amount of liquid 81 that is dispensed can also be adjusted by changing the spring compression, by varying the pressure and by changing the time interval for pressurization. Additionally, since standard industrial blunts, such as illustrated needle element 20, are manufactured in different sizes, it can also be appreciated that varying the needle size will also vary the amount of liquid 81 that is dispensed during each time interval for pressurization.

As previously stated, the valve casing 32 and the valve 70, exclusive of spring 73 and 'O' ring 73, can be conventionally machined from brass stock and then plated with chrome. Chrome plating is preferred to prevent contamination of the liquid 81. Chrome plating is required for all medicinal applications of the valve cartridge 30 of the liquid dispensing apparatus 10 of the present invention.

The illustrated preferred embodiment has been experimentally tested as having the capability of dispensing minute quanties of liquids having as low a specific gravity as that of water and a range of viscosity of between about 100 centipoise to about 600 centipoise without drip from the needle element 20 between dispensing cycles. For exempliary purposes, the illustrated, preferred embodiment can incorporate a poppet valve 70 having an overall length of the member 71 thereof, of about 41.021 mm. In this regard, member 71 can be formed from stock that is centerless ground to a diameter of about 3.137 mm. The outlet opening 35 can have a diameter of about 3.175 mm. This leaves an unplated slip clearance of between the valve 70 and the outlet opening 35 of about 0.038 mm. The 'O' ring 73 can have an outer diameter of about 3.124 mm., an inner diameter of about 1.5 mm. and a circular cross section of about 0.762 mm. Circumferential groove 72 can have an inner diameter of about 1.83 mm. 'O' ring 73 can be fabricated from Ethylene Propylene having a durometer rating of about 70. Such 'O' rings can be obtained from Apple Rubber Company of Tonawanda, N.Y. The valve seat can incorporate a slope of about 37.5 degrees. The inlet ports **76*a* through 76*f* can have a diameter of about 0.762 mm. and the outlet ports 74*a* through 74*d* can have a diameter of about 1.32 mm. The flow through channel 78 can also have a diameter of about 1.32 mm. Spring 77 can include 16.5 active turns of Phosphor Bronze wire having a diameter of about 0.608 mm. The ends of spring 77** should be ground flat. Lastly, the maximum permitted valve stroke can be about 3.175 mm.

Referring again to FIG. 1, the dispensing of liquid 81 is initiated by the closing of switch 140 for the duration of a time interval. The duration of the time interval is controlled either manually or by the use of an elapsed time timer which for illustrative purposes can be said to comprise a part of the switch 140. Upon the closing of switch 140, potential source 150 induces an electrical impulse in wire 145. This electrical impulse opens valve 90 to connect an inlet 92 thereof to a first outlet 94 thereof. An air pressure source, that can include an air compressor 130, a plenum 120 and a pair of air filters 110 and 112, all serially connected to each other by provision of the illustrated air lines 108, 106 and 104, is in turn connected to the inlet 92 to valve 90 by air line 102. Hence, upon the closing of switch 140, pressurized air flows through first outlet 94 of valve 90, through air line 100, air induction fitting 89 and into container 80 to pressurize liquid 81 therein. The pressurization forces liquid 81 through the apertures 83 of container 80. The liquid 81 then enters valve cartrage 30 through the inlet opening 33 of the casing 32. Once in the casing 32, the liquid 81 then flows into tertiary bore 66 and into the inlet ports **76*a* through 76*g*. A fluidic pressure is then exerted on valve 70 which drives the same, against the bias of spring 77, towards the needle element 20. After the valve unseats from the valve seat 58, liquid 81 flows out of the exhaust ports 74*a* through 74*d*, into the tapered bore 24 of the needle element 20 and then into axial bore 32 of hollow needle 21 thereof. When the switch 140 is opened at the end of the time interval, the valve 90 closes to connect the first outlet 94 to a second outlet 96 of valve 90. Since second outlet 96 is opened to the atmosphere, the container 80 is depressurized to atmospheric pressure by the pressurized air therein flowing through air line 100, to first outlet 94 and then out of the second outlet 96. As a result of the depressurization of container 80, pressure is thereby released from liquid 81 and the poppet valve 70 returns to its closed and seated position to seal outlet opening 35. As has been previously described, the sealing of the outlet opening 35 leaves a volume of liquid 81 remaining in needle element 20, which exerts a pressure that is opposed by the incoming atmospheric pressure acting on liquid 81 at the end 20***a* of the needle element 20. When the product of the specific gravity of the liquid 81 remaining in needle element 20 and the difference between the length of needle element 20 and the length of the nozzle member 54 sealed within tapered bore 24 of needle element 20 is less than that of the atmospheric pressure, the liquid 81 will be thus held within needle element 20 by atmospheric pressure and will not drip therefrom between dispensing cycles.

It is well known in the art, that the best dispensing results are obtained when container 80 is held at about 30 degrees. However, unlike the prior art, the needle element 20 of the present invention should not touch substrate 18. Needle element 20 should be positioned close to and directly above the area for liquid application. For this reason, the subject invention produces the best dispensing results when the dispensing apparatus thereof is held by a stand or a fixture. Suitable stands and fixtures are well known in the art and can easily be obtained from a variety of manufacturers of liquid dispensing apparatus as well as chemical supply houses.

As has been mentioned, the container 80 and the needle element 20 can be a syringe barrel and a standard industrial one half inch blunt. Moreover, air induction fitting 89 can also be a conventional fitting well known in the art. Substitutions of such illustrated elements can of course be made depending upon the dispensing requirements. For instance, container 80 could be a large container having a male luerlock fitting at the bottom thereof. However, container 80 should be air tight and needle element 20 should extend a distance from valve cartridge 30, when installed, for a proper direction of liquid 81.

The present invention is provided with means for pressurizing the container 80 for the duration of a time interval to thereby force liquid 81 from aperture 83 thereof, and for depressurizing container 80 to atmospheric pressure, simultaneously, with the end of the time interval. As mentioned, these means of the preferred embodiment can be said to include air compressor 130, plenum 120, filters 110 and 112, switch 140, potential source 150 valve 90, air induction fitting 89, as well as the associated air lines 100 through 108.

Valve 90 can be a conventional normally closed, three-way exhaust to atmosphere solenoid actuated valve. An example of such a valve is Valve #111-11BA, manufactured by Mac Valves of 30569 Beck Rd., Wixom, Mich. Other valve manufacturers provide similar valves. However, it is necessary that when the valve, such as 90, is in its closed position, an outlet such as first outlet 94 be connected to an outlet that vents to the atmosphere, such as second outlet 96. This is required in order to facilitate the immediate venting of pressurized air from container 80. It is appropriate to point out that all of the air lines 100 through 108, as well as a liquid supply line 109 which will be discussed hereinafter, can be formed from flexible, plastic tubing sized for sealable connection to air induction fitting 89, first outlet 94 etc.

Air compressor 130, plenum 120 and filters 110 and 112 are all conventional elements utilized in compressed air systems. In this regard, each of the filters 110 and 112 can be a Modd 7681-Mini 18 Turn Regulator manufactured by Arrow Pneumatics, Inc., P.O. Box 739, Mundelein, Ill. The air pressure can fall within a range of about 12.95 newtons/square meter to about 207.25 newtons/square meter for the proper functioning of valve cartridge 30. The air pressure can be adjusted in accordance with the viscosity of the liquid 81 and as previously stated, the amount of liquid 81 to be dispensed during each time interval.

Means, generally illustrated by switch 140, can be provided for connecting potential source 150 to valve 90 for the duration of the time interval for pressurization. Switch 140 can be a conventional foot operated switch. Where it is required to accurately dispense minute amounts of liquid 81, switch 140 can be any conventional manually operated switch used in conjunction with a timer. Such a timer can preferably be a conventional elapsed time, timer provided with a series of channels to induce an electrical signal in a series of wires such as 145 to control the operation of a plurality of valve cartridges, such as illustrated 30 etc. all from the same air pressure source. The controls for such timers can be of a digital or of an analog nature.

As illustrated in FIG. 1, container 80 can be provided with an air barrier 160 to prevent airation of liquid 81. In the preferred embodiment, barrier 160 can include a piston element 162 of cylindrical configuration having a pair of circumferential sealing ribs 164*a* and 164*b*. As can be seen in FIG. 1, air barrier 160 should be installed in container 80 so as to be positioned above a liquid induction fitting 170 which will be discussed in detail hereinafter. The separation between fitting 170 and barrier 160 can be about 6.35 mm. to about 9.525 mm. This separation assures that the eddy current characteristics of liquid 81 entering container 80 through fitting 170 will insure the flow of a fresh supply of liquid 81 through the unit i.e. pot life of liquid 81. A crown element 168 can be provided and connected to piston element 162 so as to underlie air induction fitting 89 when air barrier 160 is installed. Crown element 168 can include a cruciform arrangement of four right triangular ribs, with each rib having the apex thereof located at the center of piston element 164. The purpose of this is to prevent air barrier 160 from cocking and thus jamming within container 80 during operation. A pair of holes 168*a* and 168*b* can be provided in crown element 168 to facilitate removal of air barrier 160 from container 80. In the preferred embodiment, since the container 80 was fabricated from a standard syringe barrel, barrier 160 was fabricated by removing a portion of the plunger that is normally utilized therewith to form air barrier 160. The stock sealing ribs thereof were then ground to reduce the coeficient of friction between the formed ribs 164*a* and 164*b* and the interior sidewall of container 80. This is necessary to facilitate movement of the barrier 160 to pressurize liquid 81 upon the pressurization of container 80. In this regard, barrier 160 should freely move within container 80 upon the exertion of a pressure of about 12.95 newtons/square meter. Air barrier 160 can of course be omitted with the loss of its advantageous operation as described above.

Referring now to FIG. 1, container 80 can be provided with a liquid induction fitting 170, sealably connected in the sidewall of container 80. This connection and its spacing from air barrier 160 has been previously described. A liquid supply tank 172 can be located above liquid induction fitting 170 to allow liquid 81, contained therein, to gravity feed into container 80. Supply tube 109 can be provided to connect liquid induction fitting 170 to tank 172. Since very minute amounts of liquid 81 are dispensed during a time interval of pressurization, the container 80 thus resupplied with liquid 81 always remains filled. These aforementioned supply means can be omitted. However, after a suitable interval of liquid dispensing, container 80 would have to be manually replenished with liquid 81.

It will be understood by those skilled in the art that the invention has been described with reference to an exempliary preferred embodiment and that variations and modifications, in addition to those previously described, can be effected in the described embodiment without departing from the spirit and scope of the invention.

What is claimed is:

1. A liquid dispensing apparatus comprising:

a container for containing said liquid having an aperture in the bottom thereof;

a needle element for dispensing said liquid comprising a standard industrial blunt including:

a hollow needle having, a connected end;

an unconnected end opposite to said connected end;

an axial bore therethrough communicating between the said connected end and the said unconnected end; and a female coupling connected to said hollow needle having, a pair of opposed ends, a tapered bore communicating between the said opposed ends of said female coupling, with the narrowmost section of said tapered bore being in registry with said axial bore of said hollow needle at one of said opposed ends of said female coupling and at said connected end of said hollow needle and with the widestmost section of said tapered bore being located at the other of the said opposed ends of said female coupling, a mouth defined by the widesmost section of said tapered bore, and a radially extending flange connected to the outside of said female coupling level with the said mouth thereof; and means for pressurizing said container for the duration of a time interval, to thereby force said liquid from said aperture of said container, and for depressurizing said container to atmospheric pressure, simultaneously, with the end of said time interval; and an anti-drip valve cartridge, said valve cartridge comprising:

a casing operable to be located between said container and said needle element, including, a central portion, an inlet portion connected to said central portion having, an inlet opening, and means for sealably connecting said casing to said container with said inlet opening in communication with said aperture of said container, an outlet portion, spaced apart from said inlet portion and connected to said central portion, said outlet portion having, an outlet opening, and sealable connection means for sealably connecting said casing to said needle element with said outlet opening in registry with said tapered bore of said needle element, said sealable connection means for connecting said casing to said needle element including, a depending nozzle member configured to project into said mouth of said female coupling of said needle element and seal within said tapered bore thereof, said nozzle member having, a proximal end, and a distal end operable to be extended within said tapered bore of said needle element, said nozzle member connected to said central portion by its said proximal end, said nozzle member having said outlet opening located on its said distal end, and a cylindrical flange of a male luerlock fitting, said cylindrical flange connected to said central portion in a coaxial relationship with said nozzle member, with said nozzle member situated within said cylindrical flange and with said central axis of said cylindrical flange being coincident with the central axis of said nozzle member, said cylindrical flange having a plurality of threads therein configured to threadably engage said radially extending flange of said needle element, and a passageway, communicating between said inlet opening and said outlet opening; and means, associated with said outlet opening, for unsealing said outlet opening for the duration of said time interval, so that said liquid under said application of pressure is forced from said aperture of said container, into said inlet opening, through said passageway, out of said outlet opening, through said needle element and out of the said unconnected end thereof and for sealing said outlet opening simultaneously with the end of said time interval, whereby after said time interval, a volume of liquid remains in said needle element which is operable to be acted upon by said incoming atmospheric pressure at the unconnected end of said hollow needle so that when the product of the specific gravity of said liquid remaining in said needle element and the difference between the length of said needle element and the length of said nozzle member sealed within said tapered bore of said needle element is less than that of the said atmospheric pressure, said liquid will not drip from said needle element said sealing and unsealing means include an outwardly opening pressure activated poppet valve sized for reciprocating movement beyond said outlet opening of said nozzle member and within said tapered bore of said needle element between a closed and seated position when sealing said outlet opening and an open unseated position of maximum valve stroke, towards but spaced from said narrow most section of said tapered bore of said needle element, when unsealing said outlet opening, said oppet valve having means for biasing said poppet valve in its said closed and seated position;

said depending nozzle member comprises a truncated tip member of a male luerlock fitting configured to seal within said tapered bore of said needle element when extended through the said mouth thereof:

said nozzle member further has, a valve seat configured to seal against said poppet valve when in its said closed and seated position, said valve seat being located on the said distal end of said nozzle member, said valve seat having an annular configuration, the inner periphery of which defines said outlet opening and the outer perphery of which is located on the said distal end of said nozzle member.

2. The liquid dispensing apparatus of claim 1 wherein said container has a male luerlock fitting located on the bottom of said container and said aperture of said container is located on the tip member of said male luerlock fitting located on the bottom of said container; and wherein:

said inlet portion sealable connection means comprises a female luerlock fitting configured to sealably connect to the said male luerlock fitting located on the bottom of said container, said female luerlock fitting of said inlet portion sealable connection means including:

a female coupling having;

a pair of opposed ends, an axial tapered bore communicating between the said opposed ends thereof, with the widestmost section of said axial tapered bore being open to receive said tip member of said male luerlock fitting of said container and with the narrowmost section of said tapered bore defining said inlet opening at the other of the said opposed ends thereof;

a mouth defined by the widestmost section of said axial tapered bore to receive said tip member of said container; and a radially extending flange, connected to the outside of said female coupling, level with said mouth of said female coupling of said inlet portion.

3. The liquid dispensing apparatus of claim 2 wherein:

said valve seat has an inwardly sloping, frustroconnical configuration;

said pressure activated poppet valve includes an elongate member having:

a shank section of cylindrical configuration sized to produce a close fitting sliding engagement with said outlet opening, said shank section having a circumferential groove defined in one end thereof;

an 'O' ring located at the said one end of said shank section within said circumferential groove, said 'O' ring configured to seal against said valve seat when said valve is in its said seated position;

a stem section adjacent to said shank section;

a flow through channel axially extending through said stem section and said shank section to a location therein which is situated anterior to said circumferential groove;

at least one intake port defined in said stem section in communication with said flow through channel; and at least one exhaust port defined at said location anterior to said circumferential groove in communication with said flow through channel, whereby upon the application of pressure liquid flows into said at least one intake port and said flow through channel to force said poppet valve, against its said biasing means, into its unseated position wherein said liquid is expelled from said at least one exhaust port and into said needle element.

4. The liquid dispensing apparatus of claim 3 wherein:

said at least one intake port of said elongate member comprises a set of three pairs of intake ports defined along said stem section and spaced from said shank section, with each of said pairs equally spaced from another of said pairs and with each of said ports of a said pair located opposite to another of said ports, and a single intake port defined at the end of said elongate member opposite to said shank section forming said stem section.

5. The liquid dispensing apparatus of claim 4 wherein:

said at least one exhaust port of said elongate member comprises a set of four exhaust ports, each of which is opposite to another of said exhaust ports and at right angles to an adjacent exhaust port.

6. The liquid dispensing apparatus of claim 5 further comprising means for adjusting said maximum valve stroke of said valve.

7. The liquid dispensing apparatus of claim 6 wherein:

said central passageway further includes:

a primary bore of cylindrical configuration, extending inwardly from said outlet opening, towards said inlet opening, said primary bore having a diameter equal to said outlet opening and a length equal to the length of said shank section; and a secondary bore, extending inwardly from said primary bore, towards said inlet opening, having a diameter greater than the diameter of said primary bore to thereby define a primary shoulder at the innermost extent of said primary bore;

said stem section has a plurality of threads defined along the length thereof; and said valve stroke adjustment means includes a threaded clutch nut threaded onto said stem section a distance from said shank section equal to the desired maximum valve stroke, said clutch nut thereby limiting said maximum valve stroke by abutting against said primary shoulder when said valve is in its said opened and unseated position.

8. The liquid dispensing apparatus of claim 7 wherein:

said central passageway further includes a tertiary bore, extending inwardly from said secondary bore, towards said inlet opening, having a diameter greater than said secondary bore to thereby define a secondary shoulder at the innermost extent of said secondary bore;

said biasing means includes:

a helically wound spring having an outer diameter greater than said secondary bore and less than that of said tertiary bore, said spring being coaxially position with respect to said stem section with said stem section projecting through the coils of said spring; and a compression adjustment nut threaded onto said stem section a distance from the said end of said elongate member forming said stem section to thereby set said spring into compression against said secondary shoulder.

9. The liquid dispensing apparatus of claim 8 wherein said primary shoulder is tapered towards said outlet opening at an angle of less than or equal to 79 degrees as viewed with respect to the axis of said passageway.

10. The liquid dispensing apparatus of claim 9 wherein said compression adjustment nut has a convex surface in registry with said coils of said spring to thereby center said spring relative to said stem section.

11. The liquid dispensing apparatus of claim 10 wherein said end of said stem section further has a slot configured to receive the end of a screw driver.

12. The liquid dispensing apparatus of claim 11 wherein said casing is of cylindrical configuration and further includes:

a pair of separable sections forming said casing and which are operable for connection and separation at a circumferential juncture of said central portion of said casing defined by an imaginary plane passing at right angles through said central portion;

means, associated with said sections, for removably connecting said separable sections; including a threaded connection between said sections; and a gasket, located at said juncture and between said sections, to seal said casing.

13. The liquid dispensing apparatus of claims 1 or 12 wherein said pressurizing and depressurizing means include:

an air induction fitting connected to said syringe;

a normally closed, three-way exhaust to atmosphere solenoid actuated valve having, a first outlet connected to said air induction fitting, a second outlet that vents to the atmosphere and that is connected to said first outlet when said valve is in a closed position, and an inlet connected to said first outlet when said valve is in an opened position;

a plenum;

a pair of air filters, serially connected to one another, to said inlet of said valve and said plenum;

an air compressor connected to said plenum; and means for connecting a potential source to said valve for the duration of said time interval to open said valve for the duration of said time interval.

14. The liquid dispensing apparatus of claim 13 wherein said potential connection means includes an elapsed time timer.

15. The liquid dispensing apparatus of claim 14 wherein said container comprises a syringe barrel having a sidewall and an interior sidewall and wherein said liquid dispensing apparatus further comprises:

a liquid induction fitting connected to said sidewall of said container;

an air barrier positioned over said liquid induction fitting, said air barrier including:

a piston element of cylindrical configuration having a pair of circumferential sealing ribs, connected thereto, which bear against said interior sidewall of said container to prevent aeration of the liquid therein; and a crown element connected to said piston so as to underlie said air induction fitting to prevent cocking of said piston within said container during operation; and a liquid supply tank having said liquid therein, said liquid supply tank being located above said liquid induction fitting, said liquid supply tank being connected to said liquid induction fitting to allow said liquid therein to gravity feed into said container.

* * * * *